US008961066B2

(12) United States Patent
Darscheid et al.

(10) Patent No.: US 8,961,066 B2
(45) Date of Patent: Feb. 24, 2015

(54) COMPACTING MACHINE

(71) Applicant: BOMAG GmbH, Boppard (DE)

(72) Inventors: Thomas Darscheid, Boppard (DE); Robert Laux, Neuwied (DE)

(73) Assignee: BOMAG GmbH, Boppard (DE)

( * ) Notice: Subject to any disclaimer, the term of this patent is extended or adjusted under 35 U.S.C. 154(b) by 0 days.

(21) Appl. No.: 14/101,778

(22) Filed: Dec. 10, 2013

(65) Prior Publication Data

US 2014/0161529 A1 Jun. 12, 2014

(30) Foreign Application Priority Data

Dec. 10, 2012 (DE) ..... 10 2012 024 104

(51) Int. Cl.

| | |
|---|---|
| ***E01C 19/28*** | (2006.01) |
| ***E01C 19/38*** | (2006.01) |
| ***E02D 3/026*** | (2006.01) |
| ***E02D 3/074*** | (2006.01) |

(52) U.S. Cl.

CPC ..... *E01C 19/38* (2013.01); *E02D 3/026* (2013.01); *E02D 3/074* (2013.01); *E01C 19/286* (2013.01)

USPC ..... 404/117

(58) Field of Classification Search

USPC ..... 404/117, 122, 128, 130

See application file for complete search history.

(56) References Cited

U.S. PATENT DOCUMENTS

| | | | | |
|---|---|---|---|---|
| 3,026,781 | A * | 3/1962 | Schafer | 404/117 |
| 4,152,943 | A * | 5/1979 | Wall | 74/87 |
| 4,561,319 | A * | 12/1985 | Lilja | 74/61 |
| 5,062,228 | A * | 11/1991 | Artzberger | 37/407 |
| 5,934,824 | A * | 8/1999 | Vural | 404/117 |
| 6,200,066 | B1 * | 3/2001 | Humphrey | 404/117 |
| 6,386,794 | B1 | 5/2002 | Bitelli | |
| 6,467,245 | B1 * | 10/2002 | Humphrey | 56/249.5 |
| 6,829,986 | B2 * | 12/2004 | Richter | 100/155 R |
| 6,929,421 | B2 * | 8/2005 | Potts et al. | 404/117 |
| 7,186,056 | B2 * | 3/2007 | Magee | 404/117 |
| 8,556,039 | B2 * | 10/2013 | Marsolek et al. | 184/6.12 |
| 2005/0183512 | A1 | 8/2005 | Corcoran | |
| 2011/0158745 | A1 * | 6/2011 | Oetken et al. | 404/72 |

FOREIGN PATENT DOCUMENTS

| | | |
|---|---|---|
| DE | 1 098 450 B | 1/1961 |
| DE | 1 634 474 A1 | 8/1970 |
| EP | 0 945 187 A2 | 9/1999 |

OTHER PUBLICATIONS

ESPACENET, English Machine Translation of European Application No. EP0945187A2, published Sep. 29, 1999, retrieved from http://worldwide.espacenetcom on Apr. 28, 2014 (6 pages).

European Patent Office, Extended European Search Report, Application No. EP13005616.1, dated Apr. 22, 2014 (5 pages).

ESPACENET, English Machine Translation of DE1098450B, published Jan. 26, 1961 (2 pages).

ESPACENET, English Translation of DE1634474A, published Aug. 6, 1970 (2 pages).

German Patent Office, Search Report for Application No. DE102012024104.6, Sep. 24, 2013 (5 pages).

* cited by examiner

*Primary Examiner* — Gary Hartmann

(74) *Attorney, Agent, or Firm* — Wood, Herron & Evans, LLP

(57) ABSTRACT

The present invention relates to a compacting machine comprising a shaft, an unbalanced mass and a drum, wherein the shaft is connected both to the unbalanced mass and to the drum and is adapted to transfer imbalance forces from the unbalanced mass to the drum, and further wherein the shaft is mounted in a plain bearing.

11 Claims, 4 Drawing Sheets

COMPACTING MACHINE

CROSS-REFERENCE TO RELATED APPLICATIONS

The present application claims priority under 35 U.S.C. §119 of German Patent Application No. 10 2012 024 104.6, filed Dec. 10, 2012, the disclosure of which is hereby incorporated herein by reference in its entirety.

FIELD OF THE INVENTION

The present invention relates to a compacting machine comprising a shaft, an unbalanced mass and a drum, wherein the shaft is connected both to the unbalanced mass and to the drum and is adapted to transfer imbalance forces from the unbalanced mass to the drum.

BACKGROUND OF THE INVENTION

A compacting machine can take the form of a vibrating compactor. Vibrating compactors are dynamic compacting machines that are adapted to transfer energy, in addition to their own weight, into a volume to be compacted, for example, the ground. For this purpose, use is usually made of vibration produced by unbalanced masses. Vibrating compactors can be used, for example, for the purpose of compacting the subsurface of roads, runways, or dams. They take the form of, for example, agitator plates, vibrating rollers, single-drum compactors, vibratory plates, duplex rollers, or trench compactors. They can be used in the construction of roads and paths and wherever the ground or pavings have to be compacted. By this means, it is possible to improve the load bearing strength of a subsurface and to reduce subsidence.

Such vibrating compactors have at least one drum or plate, to which the vibration produced by the unbalanced mass can be transferred. The unbalanced mass is usually provided on a shaft, as, for example, an imbalance shaft mounted on roller bearings. In some cases, a plurality of adjustable unbalanced masses is provided so that various types of vibration can be produced.

Known vibration generators comprising an unbalanced mass or a plurality of unbalanced masses take up much room. The construction, thereof, is complicated and expensive. In operation, the degree of noise generated is high and a limit has been reached as regards the permissible stresses, more particularly, the centrifugal forces and rotational speeds.

SUMMARY OF THE INVENTION

The essential elements of a compacting device according to one embodiment of the present invention comprise at least one shaft, an unbalanced mass, and a drum, wherein the at least one shaft is connected to both the unbalanced mass and the drum, and is adapted to transfer the imbalance force from the unbalanced mass to the drum. According to one aspect of the present invention, the shaft has at least one exciter bearing, in which the unbalanced mass will rotate during vibration operation, wherein the exciter bearing comprises one or a plurality of plain bearings, and, in particular, exclusively plain bearings. A plain bearing comprises just a bearing surface and no additional rolling elements such as, for example, in roller bearings. A plain bearing is, thus, basically a shaft rotating in a hole. Plain bearings can comprise bushings or other bearing elements. Plain bearings are sometimes alternatively called journal bearings, slide bearings or friction bearings. It will be readily understood that any statements made hereinafter with respect to one shaft apply to compacting devices comprising a plurality of shafts as well.

The shaft is preferably one that is capable of generating vibration when rotated. Preferably, the vibration is generated on account of the fact that the shaft comprises, or is connected to, an unbalanced mass. In a particularly preferred embodiment, a shaft is adapted to rotate not only about its own axis, but also about another shaft. In one embodiment, a second shaft plus a housing forms an unbalanced mass and the second shaft and the unbalanced mass rotate about the shaft. Preferably, the shaft is adapted to be stationary during this process. The vibration produced is preferably transmitted to the drum via a driving shaft. A shaft may of course also consist of multiple components.

Thus, the exciter bearing is the bearing which is arranged between the component forming the unbalanced mass and the component supporting the unbalanced mass. In other words, by means of the exciter bearing, the component forming the unbalanced mass and the component of the compaction machine supporting the unbalanced mass are mounted and connected to each other so as to be able to move relative to one another about the axis of rotation of the unbalanced mass. According to one embodiment of the present invention, said exciter bearing is at least partially and, in particular, completely configured as a plain bearing.

A drum is the tubular wall of a rolling body. Preferably, the drum used is a smooth drum. The drum is rotatably mounted, for example, on a machine frame of the compacting machine by means of what will hereinafter be referred to as drum bearing. As opposed to the exciter bearing, the drum bearing is preferably a roller bearing. The speeds generated by the drum bearing are comparatively low and essentially depend on the respective travel speed of the compacting machine. Compared to the drum bearing, the speeds generated by the exciter bearing are relatively high and have a high frequency. As regards the shaft, in particular, the driving shaft of the drum, it can, thus, comprise a drum bearing as far as the manner in which the drum is mounted on the machine frame is concerned, for example, and, spatially separated therefrom, simultaneously an exciter bearing having an unbalanced mass which rotates during vibration operation. The present invention according to one embodiment is directed to said exciter bearing being at least partially and, in particular, completely configured as a plain bearing.

The plain bearings used are preferably hydrodynamic fluid bearings. Preferably, hydrodynamic lubrication is provided. Preferably, 0.5 liter of oil per minute are provided for lubrication.

Advantageously, the shaft, unbalanced mass, and plain bearing form a vibration generator. The vibration generator is preferably mounted at one end, but more preferably at both ends. In the case of the shaft being mounted at one end only, it is preferably connected to a driving shaft in such a manner that the vibration generator is mounted. In the case of the shaft being mounted at both ends, it is preferably additionally prolonged such that it extends axially symmetrically to the driving shaft and away therefrom on that side of the vibration generator that is opposite to the driving shaft. This portion of the shaft is bearing-mounted, so that the vibration generator is bearing-mounted at both of its opposite ends.

In one embodiment, a substantially L-shaped bracket is provided on an extension of the shaft, which bracket extends around the vibration generator and is fixed to the driving shaft side of the vibration generator. Preferably, the center of gravity of the L-shaped bracket lies in a plain bearing or adjacent to a plain bearing, so that the load thereon is small. The vibration generator is preferably driven by a commercial-type drive engine, as, for example, a geared engine.

Preference is given to the provision of a bolt-on plate for the purpose of fixing the vibration generator. Preferably, this bolt-on plate comprises a plane bolt-on face and a linear overflow oil connector.

Advantageously, the plain bearing is adapted to absorb imbalance forces and driving forces. By this means, imbalance forces and driving forces can be efficiently absorbed. In this way, it is possible to arrange the bearings in a particularly space-saving manner.

Driving forces are preferably those forces to be understood that act on the shaft as a result of pressure differences.

In one embodiment, a gear wheel is adapted to absorb small axial forces at a lateral surface.

Preferably, the plain bearing is designed such that it is particularly resistant both to wear due to rotary movements and to wear caused by imbalance forces. In one embodiment, the compacting machine is adapted to discharge hydraulic oil to a point on the plain bearing at which the components of the plain bearing are liable to be subjected to compressive imbalance forces to a particularly high extent.

In one embodiment, the compacting machine comprises a drive that complies with the principal of a hydraulic geared engine, which drive comprises a housing and a driving shaft that is adapted to transfer the vibration to the drum, and the unbalanced mass forms part of the drive, more particularly of the housing and/or the driving shaft. In this way, the unbalanced mass can be integrated in the compacting machine in a very space-saving manner. In the case of systems already equipped with hydraulic means, such as mobile machines for ground compaction, the hydraulic system can be implemented for the production of vibration and for the lubrication of the plain bearing. These objectives can, thus, be very efficiently satisfied. In such a configuration, the plain bearing is preferably arranged between the driving shaft and, for example, a part of the housing or a bearing element fixed to the housing. Additionally, the gear wheel which is arranged on the shaft rotating about the drive shaft may preferably also be accommodated in a plain bearing.

Preferably, the compacting machine comprises a drive complying with the principal of a hydraulic geared engine, which drive comprises a housing and a driving shaft that is adapted to transfer vibration to the drum, and the unbalanced mass is indirectly or directly connected to the drive, more particularly, to the housing and/or the driving shaft.

In a preferred embodiment, the hydraulic geared engine comprises two gear wheels capable of being driven by a flow of oil. Preferably, one of the gear wheels is coupled to the unbalanced mass and the other to the drum, the shafts of both gear wheels ideally being arranged in a plain bearing.

Preferably, the mass of a shaft is not axially symmetrical to the axis of rotation of the driving shaft. In a particularly preferred embodiment, a shaft rotates about the axis of rotation of the driving shaft. Preferably, the housing is adapted to rotate at least partially about a shaft, wherein the mass of the housing is not axially symmetrically distributed.

In one embodiment, the machine is powered by a distinctly overlarge hydraulic geared engine, which is adapted to run at reduced pressure. Preferably, a hydraulic geared engine being able to run at a permissible pressure of approximately 200 bar in continuous operation is operated at approximately 50 bar. By this means, the bearings have leeway for additional radial loads so that they can absorb imbalance forces in addition to the driving forces.

In a preferred embodiment, the drive comprises a first gear wheel, a second gear wheel, a first shaft and a second shaft, wherein the first gear wheel is connected to the first shaft and the second gear wheel to the second shaft, and the first gear wheel engages the second gear wheel, the first shaft being connected to the driving shaft and the axis of the second shaft not being in alignment with the axis of the driving shaft. In the case of such a construction, the unbalanced mass can be provided in a very simple manner. Preferably, the unbalanced mass comprises the second shaft with the second gear wheel. The second shaft comprising the second gear wheel preferably rotates about the axis of rotation of the driving shaft. In a particularly preferred embodiment, the unbalanced mass comprises that portion of the housing of the drive that encloses the second shaft and the second gear wheel. This portion of the housing is preferably adapted to rotate about the axis of rotation of the driving shaft. Advantageously, the unbalanced mass of this portion of the housing is not axially symmetrical to the axis of rotation of the driving shaft. The first and the second shaft are preferably each mounted in a respective plain bearing. Thus, in addition to these plain bearings in which the first and the second shaft are mounted, the overall configuration further comprises at least one drum bearing which is arranged separately from said plain bearings and by means of which the drum is rotatably mounted on the machine frame.

In particular, compact constructions can be realized by combining the drive, the shaft and the plain bearing to form a subassembly. In this way, a very simple construction can be realized.

Advantageously, the subassembly is adapted such that it can be connected as a whole to other components for the purpose of producing vibration therein.

Preferably, there is communication between a toothed gear system of the drive and the plain bearing, so that the oil that can be used for driving the hydraulic geared engine can be passed on to the plain bearing, where it may be implemented for lubrication of the bearings. By this means, the lubrication of the plain bearing can be carried out in a very simple manner. There is no need to provide an oil pump and an oil filter for the express purpose of lubrication and maintenance of these portions or to provide a clean space.

The oil used is preferably hydraulic oil. The pressure at which the oil is transported to the hydraulic geared engine can also be implemented for passing the oil to the plain bearing. In a preferred embodiment, oil is passed to the plain bearing by means of centrifugal forces, which are formed due to rotation of a shaft about a driving shaft.

It is advantageous to adapt the space in which the plain bearing is disposed such that it is capable of being completely filled with oil. This is a very simple way of ensuring adequate lubrication of the plain bearing. Preferably, the amount of oil used for lubrication of the bearings is very small and is kept in the order of magnitude of one liter per minute.

Preferably, the construction space surrounds the plain bearing almost completely.

It is advantageous when the space in which the plain bearing is disposed comprises both an influent duct and an effluent duct, such that the plain bearing is adapted to be located in a flow of oil and the heat from the plain bearing is capable of being dissipated via the flow of oil. Overheating of the plain bearing can, thus, be prevented in a simple manner.

The size of the space in which the plain bearing is disposed is advantageously restricted such that the oil that surrounds the plain bearing can be replaced quickly enough for the dissipation of an adequate quantity of heat.

In one embodiment, the compacting machine is adapted to achieve heat dissipation via the preferably high flow of driving oil. For this purpose, the heat from the plain bearing is preferably transferred to a toothed gear system of the hydraulic geared engine so that it can be dissipated with the driving oil.

In a preferred embodiment, the compacting machine comprises two or more shafts, of which the rotational speed and/or position are controllable, so that a direction of vibration can be set. The energy of compaction can, thus, be selectively used and adapted to requirements. Preferably, this makes it possible to achieve directional vibration and/or a modifiable direction thereof, more particularly, a directional and/or modifiable amplitude.

In a particularly preferred embodiment, the shafts are adapted to be capable of rotating independently of each other such that they can be caused to rotate at different rotational speeds and/or phase positions relatively to each other. By this means, different types of vibration can be provided, which are continuously repeated.

Preferably, a detector and an indicator are provided, wherein the detector is adapted to detect the position and/or rotational speed of a shaft and to forward the relevant data to the indicator. Thus, an operator of the compacting machine will obtain information concerning the position and/or rotational speed of a shaft and can vary the same as required. By this means, the selective adjustment of a directional vibration, more particularly, of a directional amplitude and/or a modifiable direction is simplified.

The detector used is preferably an electrical detector, more preferably, a Hall effect sensor having a magnetic ring or an inductive detector.

The indicator used is preferably a display or a number of light signaling units standing for various settings.

Advantageously, a controlling or regulating device is provided, by means of which the operator can adjust the position and/or rotational speed of a shaft. Preferably, a hydraulic valve is provided, by means of which the flow of oil can be influenced so as to modify the position and/or rotational speed of a shaft. In the case of the provision of a hydraulic geared engine, it is preferred that the hydraulic valve can be opened by various amounts for the purpose of varying the rate of the volumetric flow to the toothed gear system so that, in this way, the rotational speed of the gear wheels can be influenced.

In a particularly preferred embodiment, software is provided, which is adapted to process the position and/or rotational speed registered by the detector and to control the drives in an appropriate manner. The software can make it possible to adjust the position and/or rotational speed of a shaft as required. By this means, the operator is relieved of this task. Preferably, the software is adapted such that it carries out adjustments continuously during operation. In this way, adjustments can be carried out very frequently.

BRIEF DESCRIPTION OF THE DRAWINGS

The present invention is further described below with reference to exemplary embodiments illustrated in the drawings. In the diagrammatical drawings.

DETAILED DESCRIPTION OF THE INVENTION

Figure 1:
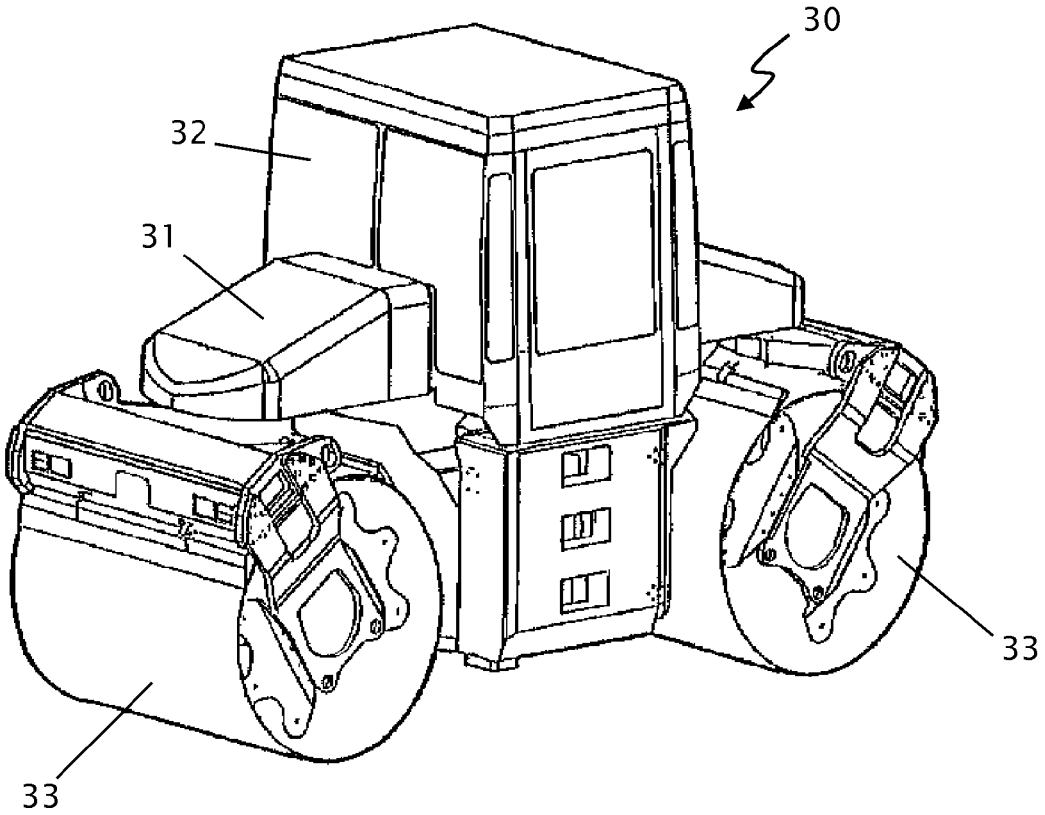
FIG. 1 shows a compacting machine.

FIG. 1 illustrates a compacting machine 30 in the form of a vibratory roller, as used for compacting a subsurface in areas constructed for traffic. It comprises a frame 31, an operator's cabin 32 and one or two drums 33. Within at least one drum there is situated a vibration generator for the purpose of producing vibration for transference by the respective drum 33 to the subsurface.

Figure 2:
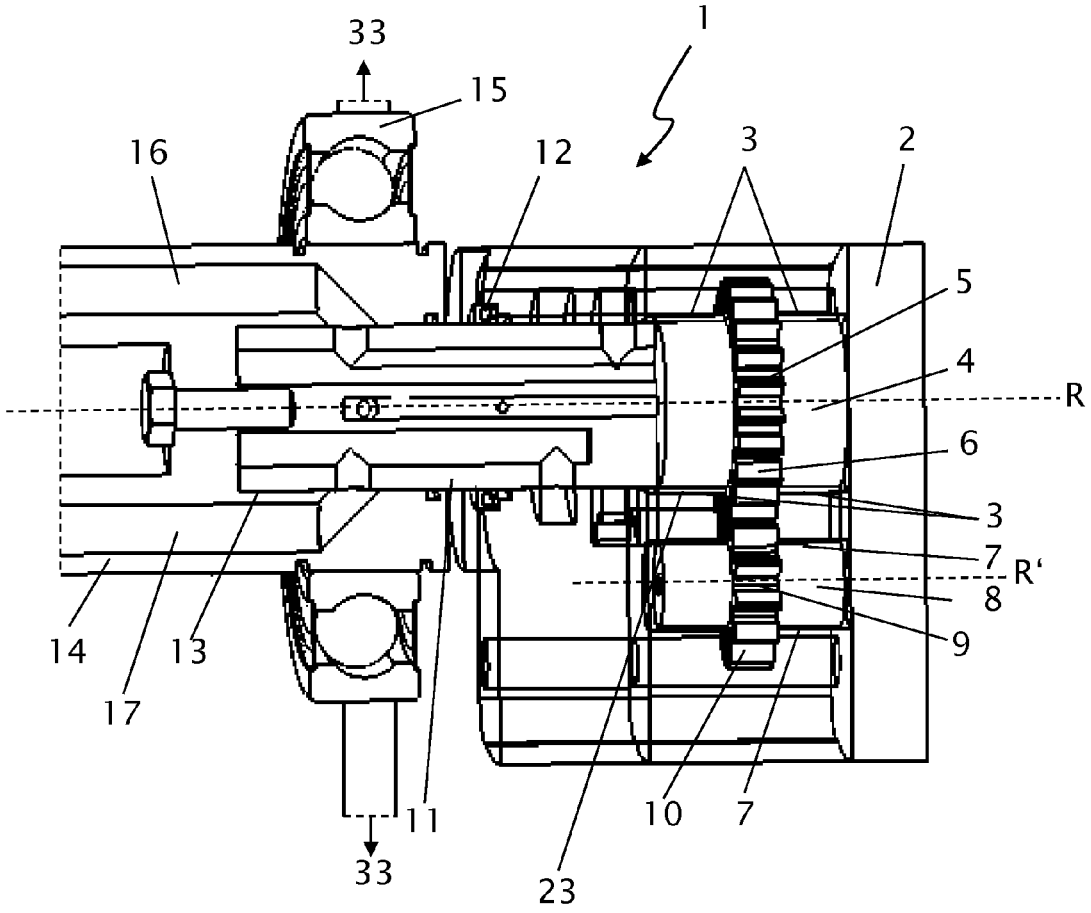
FIG. 2 shows a vibration generator.

FIG. 2 shows a vibration generator 1 comprising a housing 2, in which a first shaft 4 is mounted by means of a first plain bearing 3. The first shaft 4 is provided with a first gear wheel 5 that comprises a first toothed gear system 6. A second shaft 8 is mounted in the housing 2 by means of a second plain bearing 7. The second shaft 8 is provided with a second gear wheel 9, which comprises a second toothed gear system 10. The first shaft 4 and the second shaft 8 and, also, the first gear wheel 5 and the second gear wheel 9 are disposed such that the first toothed gear system 6 and the second toothed gear system 10 engage each other and the first gear wheel 5 meshes with the second gear wheel 9. The first shaft 4 transitions into the driving shaft 11. Thus, the shaft 4 is not formed integrally with the driving shaft 11 as one piece. The first shaft 4 is mounted axially symmetrical to the driving shaft 11. The second shaft 8 is mounted such that its rotation axis is not in alignment with the rotation axis of the driving shaft 11 and the first shaft 4.

Between the housing 2 and the driving shaft 11 there is provided a packing ring 12. By means of a press fit joint 13, the driving shaft 11 is connected to a drum holding fixture 14 which is mounted in the drum 33 by means of the drum bearing 15. The drum bearing 15 and the exciter bearing 23 are, thus, separated spatially and functionally. The drum holding fixture 14 has an influent duct 16, which continues within the driving shaft 11 and extends to the first toothed gear system 61 the second toothed gear system 10, to the first plain bearing 3 and the second plain bearing 7. There is, also, provided an effluent duct 17, which extends from the first toothed gear system 6, the second toothed gear system 10, the first plain bearing 3, and the second plain bearing 7 through the driving shaft 11 and the drum holding fixture 14. The influent duct 16 and effluent duct 17 are in each case connected to a hydraulic oil supply device (not shown).

In operation, hydraulic oil is passed through the influent duct 16 to the first gear wheel 5 and to the second gear wheel 9. By this means, the first gear wheel 5 and the second gear wheel 9 rotate together with the first shaft 4 and the second shaft 8, as powered by the hydraulic geared engine.

Oil is fed through the influent duct 16 also to the first plain bearing 3 and to the second plain bearing 7. In this case, approximately 0.5 l/min of oil or more is fed to the first plain bearing 3 and to the second plain bearing 7. This ensures that hydrodynamic lubrication takes place in the plain bearings 3, 7.

The substantially closed, rotating housing 2 requires a seal only at one location. On account of the low internal pressure present at that location, a cheap gasket is sufficient.

During the operation of the vibration generator 1, the first gear wheel 5 meshes with the second gear wheel 9. On account of the fact that the first shaft 4 is mounted axially symmetrical to the driving shaft 11 in axis R and that the second shaft 8 is mounted such that its rotation axis R' runs parallel to the rotation axis R of the driving shaft 11, as in the illustrated example, there is formed an unbalanced mass. This unbalanced mass comprises the weight of the second shaft 8 comprising the second gear wheel 9 and the region of the housing 2 enclosing the second shaft 8 comprising the second gear wheel 9. This unbalanced mass, when rotating about the rotation axis R of the first shaft in vibration operation, produces vibration, which is transferred by the driving shaft 11 and the drum holding fixture 14 to a drum which is not shown but indicated by arrows 33. Thus, the first plain bearing 3 forms an exciter bearing since it is the bearing in which the unbalanced mass of the vibration generator 1 rotates during vibration operation. In addition thereto, and separate therefrom, a drum bearing 25 is provided between the driving shaft 11 and the drum 33, which drum bearing, as in the present embodiment, preferably is a roller bearing of known type, in which the drum 33 of the compacting machine 30 rotates about the drum holding fixture 14 during travel operation.

Due to the fact that only the plain bearings 3,7 are used for the purpose of mounting the shafts 4, 8, the vibration generator 1 can withstand high stresses, and high rotational speeds can be employed. The vibration generator 1 is quiet compared with the use of conventional mounts in roller bearings. The construction can be effected in a space-saving manner. The plain bearings 3, 7 absorb both driving forces and centrifugal forces.

Due to the fact that the plain bearings 3,7 are supplied with the same oil as the gear wheels 5,9, the vibration generator 1 can have very space-saving dimensions. This type of oil supply is particularly efficient in systems already equipped with hydraulic means.

Figure 3:
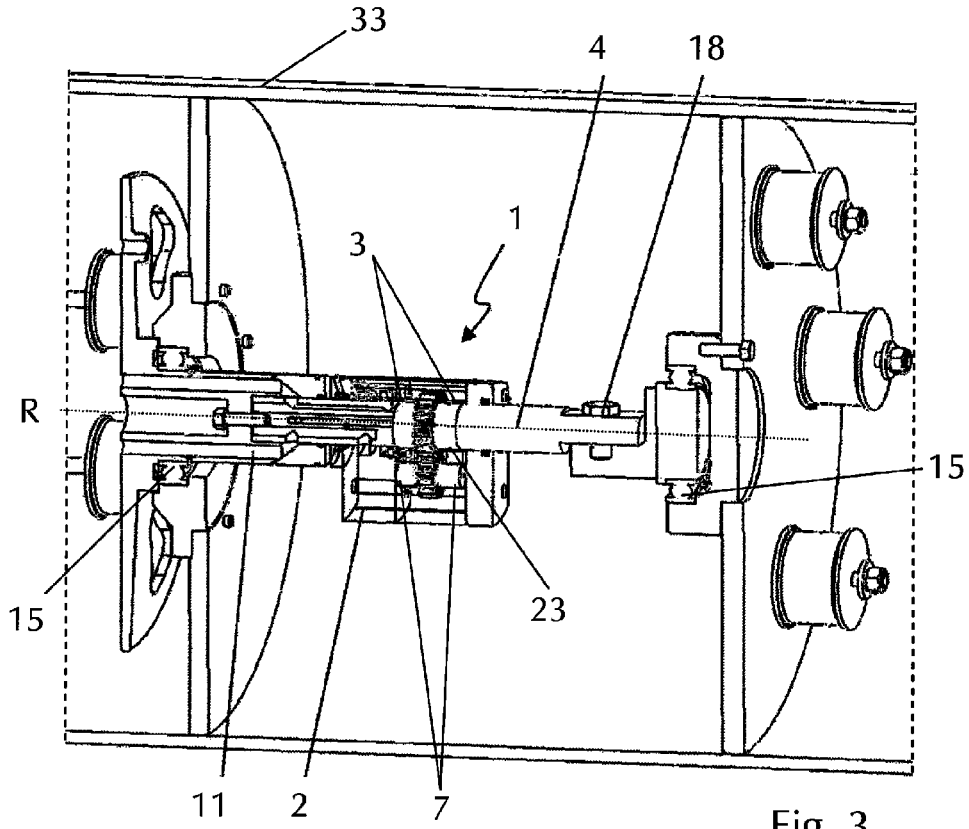
FIG. 3 shows a vibration generator, which is mounted in bearings at both ends.

FIG. 3 shows a vibration generator 1 with bearings at both ends. This vibration generator 1 is not only mounted such that the first shaft 4 transitions into the driving shaft 11, but also that the first shaft 4 passes through that side of the housing 2 that is opposite to the driving shaft 11 and is rigidly fixed outside the housing 2 by a bolt 18, with a further drum bearing 15 being provided at this end of the driving shaft 11 in extension thereof. In terms of further construction, the vibration generator 1 is comparable to the embodiment shown in FIG. 2, so that in this respect reference is made to the aforesaid. Here too the exciter bearing 23 is configured as a plain bearing 3, by means of which the housing 2 rotates about the axis R in vibration operation. Consequently, the drum bearings 15 and the exciter bearing 23 are spatially separated here too.

Due to this double-ended mounting method, the vibration generator 1 is mounted in a particularly reliable manner.

Figure 4:
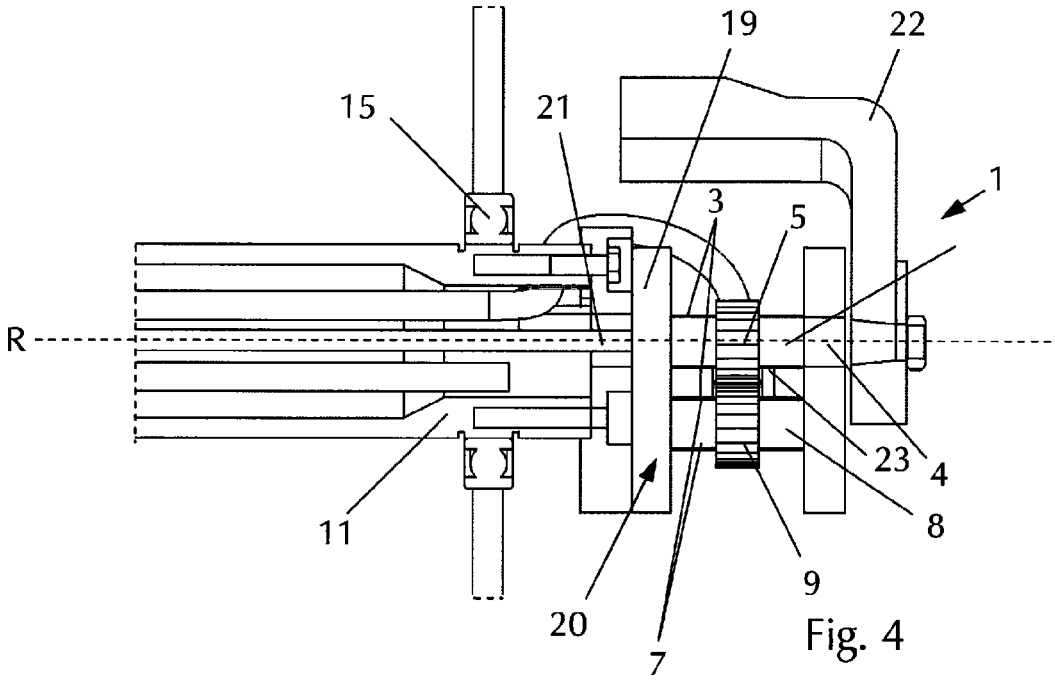
FIG. 4 shows a conventional vibration generator fixed by means of a bolt-on plate and a bracket.

FIG. 4 shows a vibration generator 1, which is fixed to the drum holding fixture 14 by means of a bolt-on plate 19. This bolt-on plate 19 has a plane bolt-on face 20 and a linear overflow oil connector 21.

On that side of the vibration generator 1 that is situated opposite to the bolt-on plate 19, there is provided a bracket 22, in which a prolonged portion of the first shaft 4 is accommodated. This bracket 22 extends towards the bolt-on plate 19 in such a manner that the center of gravity lies in the region of the bearing.

By this means, the vibration generator 1 can, on the one hand, be securely mounted without placing an additional load on the driving shaft 11, while, on the other hand, the bracket 22 makes it possible to position the vibration generator 1 on one side, so that the space available for construction can be better exploited.

During vibration operation, the bracket and the first shaft 4 rotate about the axis R in the manner described above, with the bracket acting as the unbalanced weight, comparable to the housing 2. The exciter bearing 23 is configured as plain bearing 3.

The engine used is one that is distinctly overlarge for driving purposes and that runs at reduced pressure. In this case, an engine being able to run at a permissible oil pressure of 200 bar in continuous operation is used at a distinctly lower pressure of, say, 50 bar. By this means, the bearings have leeway for additional radial stresses and can absorb the forces resulting from the unbalanced mass.

Alternatively, two vibration generators 1 can be coupled to each other such that they rotate in opposite directions. By means of appropriate regulating means, the two vibration generators can be controlled so as to make a directional amplitude and a change in direction, thereof, possible similarly to that known in vibrating plates and certain rollers, as, for example, the Asphalt Manager.

In order to make it possible to control of the two vibration generators, a hydraulic valve (not shown) is provided, by means of which the oil supply can be regulated in a specific manner.

Furthermore, a Hall effect sensor comprising a magnetic ring can be provided for the acquisition of the rotational speed and the position of a shaft 4, 8. By the acquisition of the current rotational speed and the position of a shaft 4, 8, the vibration can be controlled more specifically.

The Hall effect sensor can be used for the purpose of feeding the registered data to an indicator and/or to software. The operator or the software can then adjust the oil supply according to the data registered.

Figure 5:
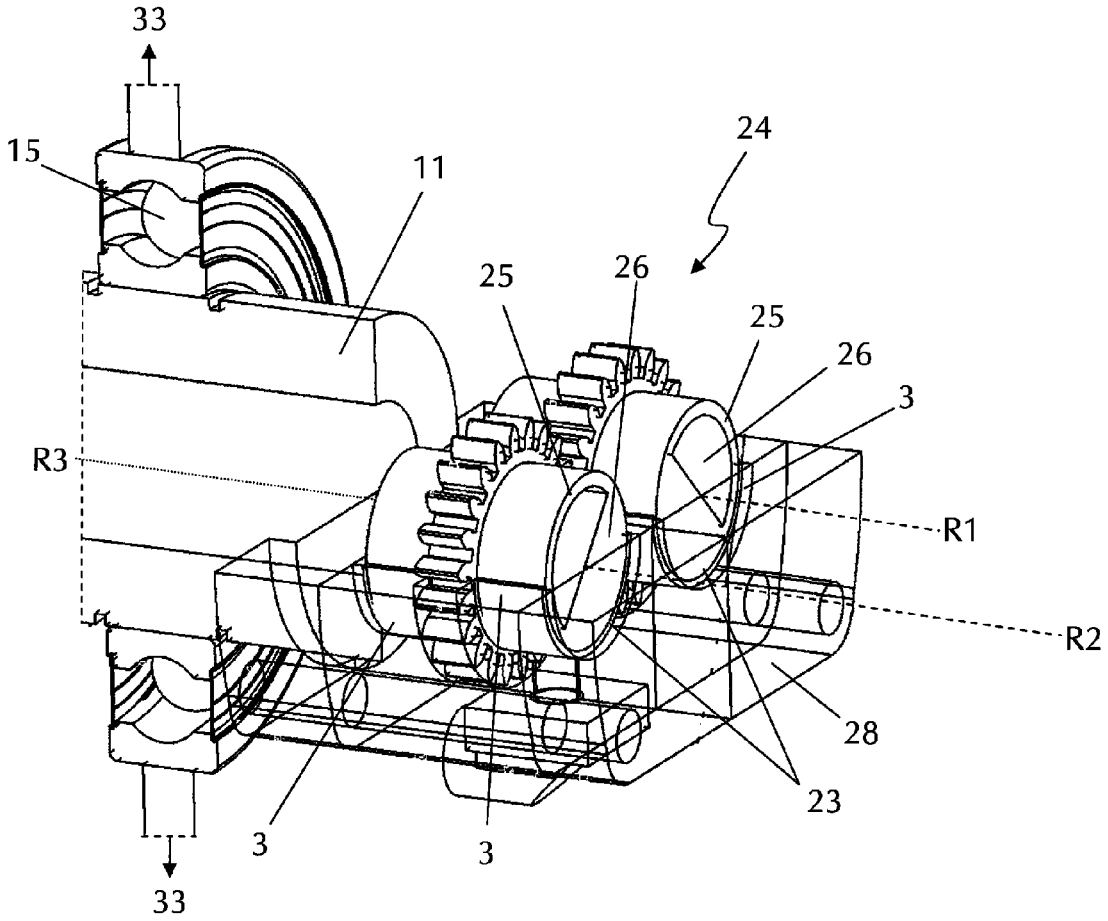
FIG. 5 shows imbalance masses in the shafts of a geared engine.

FIG. 5 shows unbalanced masses in the shafts 25 of a geared engine 24 (cover removed). These shafts 25 are solid or provided with an unbalanced mass 26 at one end and are hollow at the other end. In operation, these shafts 25 produce vibration due to the fact that their masses are not axially symmetrically distributed.

By varying the alignment of the shafts 25 relatively to each other, it is possible to influence the vibration in a specific manner. A directional amplitude can be produced.

Here again, the shafts 25 are mounted in plain bearings 27 in a housing 28. In this way, high rotational speeds can be achieved, large unbalanced masses 26 can be provided, and the construction is space-saving. Thus, according to this embodiment, the unbalanced masses 26 form a respective part of the shafts 25. Each shaft is equipped with a respective exciter bearing 23, which is configured as a plain bearing 3, between the shaft and the housing 28. During vibration operation, the shafts 25 rotate about the shafts R1 and R2. Parallel thereto and spatially separated from the exciter bearings 23, the rotation axis R3 of the drum 33 extends through the drum bearing 15.

In summary, the essential feature of the present invention is the fact that in the various embodiments the exciter bearing 23 is configured as a plain bearing.

While the present invention has been illustrated by description of various embodiments and while those embodiments have been described in considerable detail, it is not the intention of Applicants to restrict or in any way limit the scope of the appended claims to such details. Additional advantages and modifications will readily appear to those skilled in the art. The present invention in its broader aspects is therefore not limited to the specific details and illustrative examples shown and described. Accordingly, departures may be made from such details without departing from the spirit or scope of Applicants' invention.

What is claimed is:

1. A compacting machine, comprising:

at least one shaft;

an unbalanced mass; and a drum, wherein said at least one shaft is connected to both the unbalanced mass and the drum and is adapted to transfer imbalance forces from said unbalanced mass to said drum, wherein said at least one shaft has at least one exciter bearing, in which the unbalanced weight rotates during vibration operation, and that the at least one exciter bearing is a plain bearing.

2. The compacting machine according to claim 1, wherein said plain bearing is adapted to absorb imbalance forces and driving forces.

3. The compacting machine according to claim 1, wherein said compacting machine comprises a drive complying with the principal of a hydraulic geared engine, that said drive comprises a housing and a driving shaft and is adapted to transfer vibration to said drum and that said unbalanced mass forms part of said drive.

4. The compacting machine according to claim 3, wherein said drive comprises a first gear wheel, a second gear wheel, a first shaft and a second shaft, that said first gear wheel is connected to said first shaft and said second gear wheel is connected to said second shaft, that said first gear wheel engages said second gear wheel, that said first shaft is connected to said driving shaft and the axis of said second shaft is not in alignment with the axis of said driving shaft.

5. The compacting machine according to claim 1, wherein said drive, said at least one shaft and said plain bearing are combined to form a subassembly.

6. The compacting machine according to claim 3, wherein said drive comprises a toothed clear system in communication with said plain bearing, such that oil used for said drive of said hydraulic geared engine passed on to said plain bearing for lubrication of the plain bearing.

7. The compacting machine according to claim 1, wherein a space in which the plain bearing is disposed is capable of being completely filled with oil.

8. The compacting machine according to claim 1, wherein a space in which said plain bearing is disposed comprises both an influent duct and an effluent duct, such that said plain bearing is adapted to be located in a flow of oil and heat from said plain bearing can be dissipated via said flow of oil.

9. The compacting machine according to claim 1, wherein said compacting machine comprises two or more shafts of which the rotational speed and/or position can be regulated so as to set a direction of vibration.

10. The compacting machine according to claim 9, wherein a detector and an indicator are provided, wherein said detector is adapted to detect the position and/or rotational speed of a shaft and to forward the acquired data to said indicator.

11. The compacting machine according to claim 10, wherein software is provided, which is adapted to process the position and/or rotational speed detected by said detector and to control the drives in an appropriate manner.

* * * * *